US011957200B2

(12) United States Patent
Pietrzak et al.

(10) Patent No.: US 11,957,200 B2
(45) Date of Patent: Apr. 16, 2024

(54) HELMET

(71) Applicant: MIPS AB, Täby (SE)

(72) Inventors: Christopher Pietrzak, Täby (SE); Peter Halldin, Täby (SE)

(73) Assignee: MIPS AB (SE)

( * ) Notice: Subject to any disclaimer, the term of this patent is extended or adjusted under 35 U.S.C. 154(b) by 306 days.

(21) Appl. No.: 17/289,397

(22) PCT Filed: Oct. 31, 2019

(86) PCT No.: PCT/EP2019/079918
§ 371 (c)(1),
(2) Date: Apr. 28, 2021

(87) PCT Pub. No.: WO2020/089434
PCT Pub. Date: May 7, 2020

(65) Prior Publication Data

US 2021/0392985 A1 Dec. 23, 2021

(30) Foreign Application Priority Data

Nov. 2, 2018 (GB) ..... 1817960

(51) Int. Cl.
*A42B 3/06* (2006.01)
*A42B 3/12* (2006.01)

(52) U.S. Cl.
CPC ..... *A42B 3/064* (2013.01); *A42B 3/127* (2013.01)

(58) Field of Classification Search
CPC ..... A42B 3/064; A42B 3/127
See application file for complete search history.

(56) References Cited

U.S. PATENT DOCUMENTS

| | | | | |
|---|---|---|---|---|
| 6,185,753 | B1 | 2/2001 | Arai | |
| 6,701,535 | B2 * | 3/2004 | Dobbie | A42B 3/085 2/6.1 |
| 7,854,023 | B2 * | 12/2010 | Ando | A42B 3/328 2/424 |
| 8,863,319 | B2 * | 10/2014 | Knight | A42B 3/14 2/411 |
| 9,095,179 | B2 * | 8/2015 | Kwan | A42B 3/063 |
| 9,681,697 | B2 * | 6/2017 | Ikeda | A42B 3/142 |
| 2012/0174294 | A1 * | 7/2012 | Sackett | A42B 3/127 2/414 |
| 2016/0037853 | A1 | 2/2016 | Ikeda | |
| 2017/0291095 | A1 | 10/2017 | Erb et al. | |

(Continued)

FOREIGN PATENT DOCUMENTS

| | | | |
|---|---|---|---|
| CN | 104244754 | A | 12/2014 |
| EP | 0346608 | A2 | 12/1989 |
| EP | 3117726 | A1 | 1/2017 |

(Continued)

*Primary Examiner* — Tajash D Patel
*Assistant Examiner* — Tejash Patel
(74) *Attorney, Agent, or Firm* — Perkins Coie LLP

(57) ABSTRACT

A cheek pad for a helmet, the cheek pad comprising: an outer layer; an inner layer; and a sliding interface between the outer layer and the inner layer; wherein the outer layer and the inner layer are configured to slide relative to each other at the sliding interface, in response to an impact to the helmet, and the inner layer is configured to contact a side of the wearer's face, when the cheek pads are arranged in the helmet and the helmet is worn.

20 Claims, 6 Drawing Sheets

(56) References Cited

U.S. PATENT DOCUMENTS

| | | | | |
|---|---|---|---|---|
| 2020/0375300 | A1* | 12/2020 | Green | B32B 3/14 |
| 2022/0087355 | A1* | 3/2022 | Wagnac | A42B 3/124 |

FOREIGN PATENT DOCUMENTS

| | | | |
|---|---|---|---|
| WO | 0145526 | A1 | 6/2001 |
| WO | 2011139224 | A1 | 11/2011 |
| WO | 2013104073 | A1 | 7/2013 |
| WO | 2015121787 | A1 | 8/2015 |

* cited by examiner

HELMET

RELATED APPLICATIONS

This application is a 35 USC § 371 National Stage application of International Application No. PCT/EP2019/079918, entitled "HELMET," filed on Oct. 31, 2019, which claims the benefit of United Kingdom Patent Application No. 1817960.6, filed on Nov. 2, 2018, the disclosure of which is incorporated herein by reference in its entirety.

The present disclosure relates to helmets. In particular, the disclosure relates to helmets comprising cheek pads, and the cheek pads themselves.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device (or interface layer) for interfacing with a wear's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotational energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include concussion, subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either SDH, DAI or a combination of these injuries can be suffered. Generally speaking, SDH occur in the case of accelerations of short duration and great amplitude, while DAI occur in the case of longer and more widespread acceleration loads.

Attempts have been made to incorporate systems that protect against rotational forces from an impact in full-face helmets, which cover part of the wearers face. However, the ability of prior art devices to protect against rotational forces is limited because the shape of the jaw limits sliding displacement. The present invention aims to at least partially address this problem.

A first aspect of the disclosure provides cheek pad for a helmet, the cheek pad comprising: an outer layer; an inner layer; and a sliding interface between the outer layer and the inner layer; wherein the outer layer and the inner layer are configured to slide relative to each other at the sliding interface, in response to an impact to the helmet, and the inner layer is configured to contact a side of the wearer's face, when the cheek pads are arranged in the helmet and the helmet is worn.

Optionally, the outer layer and the inner layer respectively comprise multiple sections; and the outer layer and the inner layer each have distinct surfaces, corresponding to each of the multiple sections, at the sliding interface. Optionally, each section of the outer layer opposes a corresponding section of the inner layer at the sliding interface.

Optionally, at least two of the multiple sections of the outer layer and/or the inner layer have substantially different thicknesses.

Optionally, the distinct surfaces at the sliding interface of the outer layer and the inner layer are respectively concave and convex. Optionally, the distinct surfaces at the sliding interface of the outer layer and the inner layer are substantially spherical surfaces.

Optionally, the distinct surfaces at the sliding interface of at least two of the multiple sections of the outer layer and/or the inner layer have different curvatures to each other. Optionally, the distinct surfaces having different curvatures are substantially concentric spherical surfaces.

Optionally, the multiple sections of the outer layer and/or the inner layer are formed as a single piece. Optionally, the multiple sections of the outer layer and/or the inner layer are formed as multiple respective pieces. Optionally, respective pieces of the inner layer are configured to slide independently of each other relative to the outer layer.

Optionally, the cheek pad further comprises an intermediate layer between the outer layer and the inner layer configured to facilitate the sliding between the outer layer and the inner layer. Optionally, the intermediate layer comprises a layer of low friction material provided on, attached to, or integrated with, one or both of the outer layer and the inner layer.

Optionally, at least one of the outer layer and the inner layers is an energy absorbing layer configured to absorb a radial energy component of an impact. Optionally, the inner layer is a comfort padding layer configured to provide comfort to the wearer.

Optionally, the cheek pad further comprises at least one connector connecting the outer layer and the inner layer, and configured to allow the outer layer and the inner layer to slide relative to each other.

A second aspect of the invention provides a helmet comprising: an outer shell; an inner shell, arranged within the outer shell to protect the skull of the wearer from an impact; and the cheek pad of the first aspect, arranged within the outer shell to protect the side of the face of the wearer from an impact.

Optionally, the helmet comprises a further sliding interface between the outer shell and the inner shell, wherein the outer shell and the inner shell are configured to slide relative to each other at the further sliding interface, in response to an impact to the helmet.

Optionally, the helmet comprises a further sliding interface between an outer part of the inner shell and inner part of the inner shell, wherein the outer part of the inner shell and the inner part of the inner shell are configured to slide relative to each other at the further sliding interface, in response to an impact to the helmet.

Optionally, surfaces of the outer and/or inner shells at the further sliding interface are substantially spherical surfaces.

Optionally, surfaces of the inner and outer layers of the cheek pad at the sliding interface are substantially spherical surfaces substantially concentric with the substantially spherical surfaces of the shells.

Optionally, the substantially spherical surfaces of the outer and inner layers of the cheek pad have substantially the same curvature as the substantially spherical surfaces of the outer and inner shells respectively.

Optionally, the helmet comprises comprising: an interface layer between the inner shell and the wearer's head and configured to provide an interface for the helmet with the wearer's head, when the helmet is worn; and a further sliding interface between the inner shell and the interface layer; wherein the inner shell and the interface layer are configured to slide relative to each other at the further sliding interface, in response to an impact to the helmet. Optionally, the interface layer comprises comfort padding configured to provide comfort to the wearer.

Optionally, the outer shell is a relatively hard shell compared to the inner shell.

Optionally, the inner shell is an energy absorbing shell configured to absorb a radial energy component of an impact.

The invention is described below by way of non-limiting examples, with reference to the accompanying drawings, in which.

Figure 1:
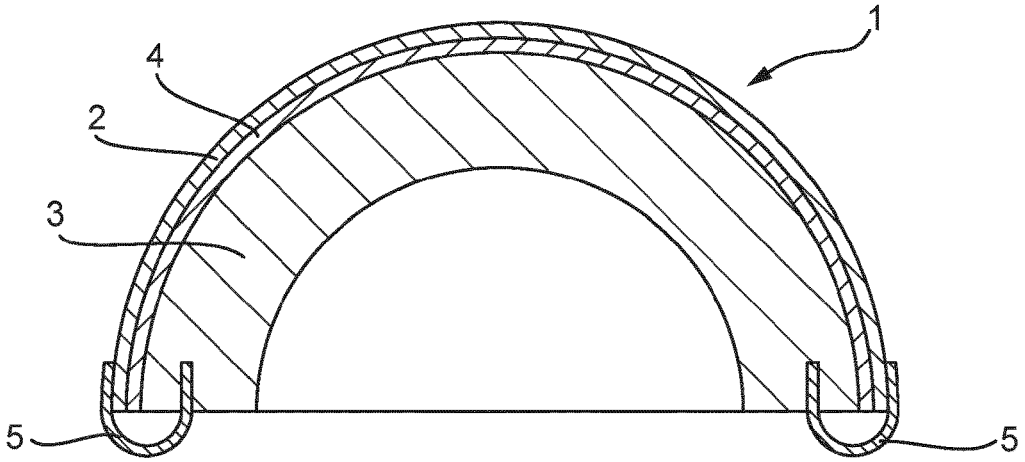
FIG. 1 depicts a cross section through a helmet for providing protection against oblique impacts.

The proportions of the thicknesses of the various layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer. Alternatively a comfort padding layer, or separate attachment device, may be additionally provided to contact the wearer's head.

Arranged between the outer shell 2 and the inner shell 3 is a sliding layer 4 or a sliding facilitator (also referred to as an intermediate layer), and thus makes possible displacement between the outer shell 2 and the inner shell 3 at a sliding interface. In particular, as discussed below, a sliding layer 4 or sliding facilitator may be configured such that sliding may occur between two the parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may be different, or not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a gel, a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic (e.g. an elastomer) or metal which are anchored in the outer shell and the inner shell in a suitable manner.

Figure 2:
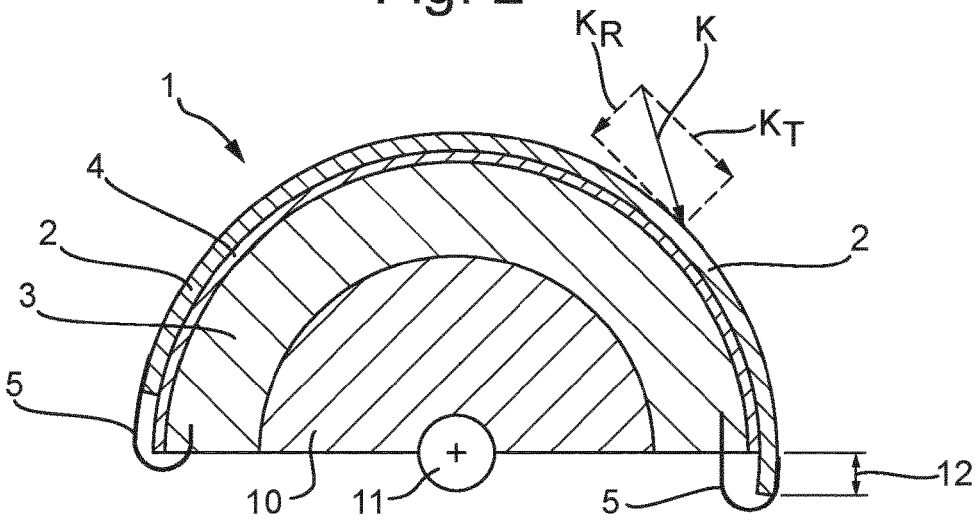
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
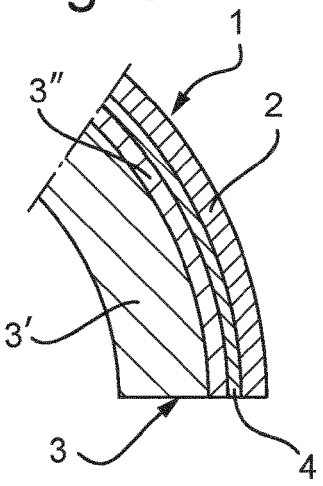
FIGS. 3A, 3B & 3C show variations of the structure of the helmet of FIG. 1.
Figure 3B:
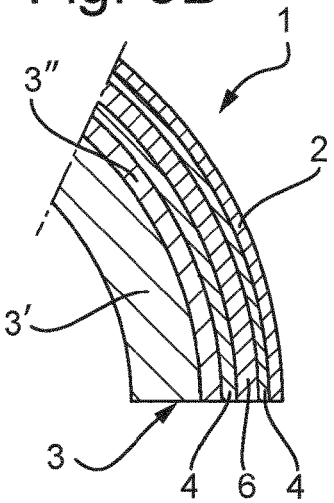
Figure 3C:
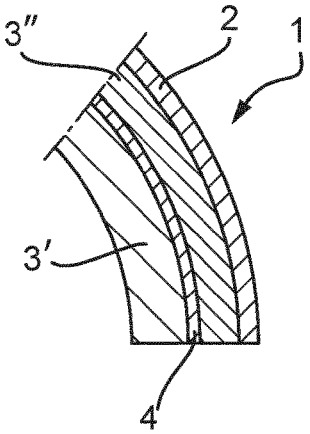

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" may be harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the inner shell 3 comprises an outer part 3" and an inner part 3'. The inner part 3' maybe the same material as the outer part 3". The sliding facilitator 4 is provided between the inner and outer parts 3', 3".

Figure 4:
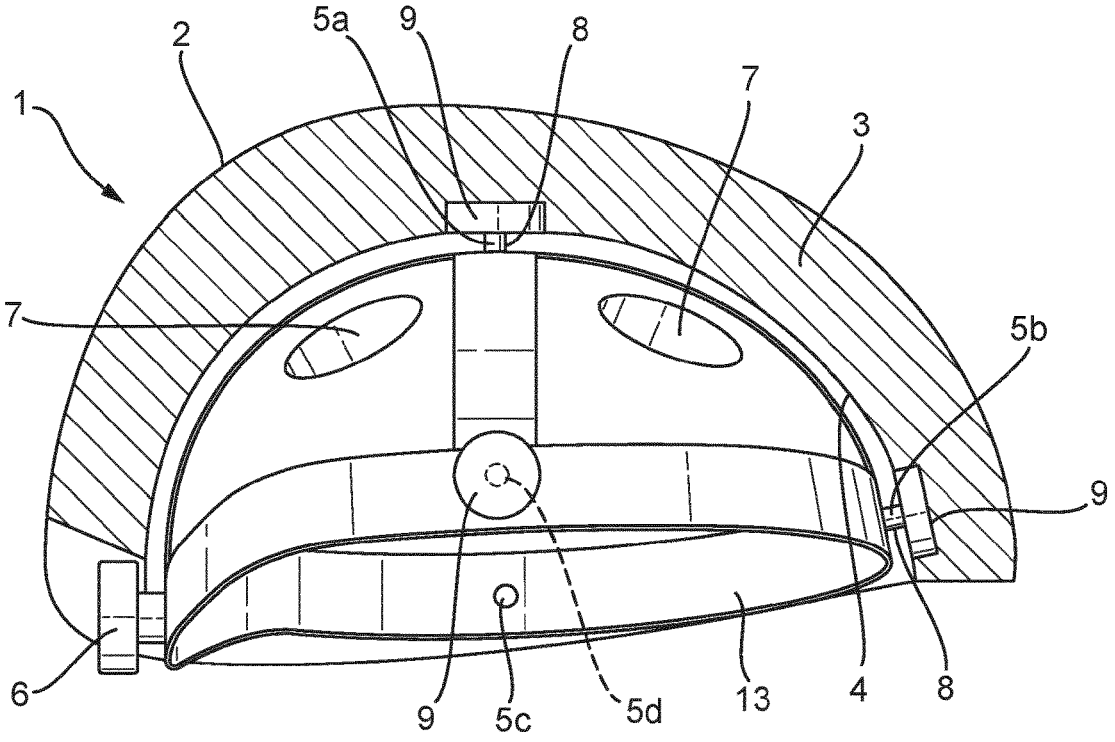
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device (or interface layer) 13 is provided for attachment of the helmet 1 to a wearer's head. The attachment device 13 may be configured to be attached to the wearer's head. As previously discussed, this may be desirable when the energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13. Alternatively the attachment device 13 may comprise a layer of comfort padding.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded. However, the attachment device 13 is not necessarily adjustable.

A sliding facilitator 4 is provided radially inwards of the energy absorbing layer 3 i.e. closer to the wearers head. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13 at a sliding interface, in the same manner as discussed above. The sliding facilitator 4 may be a material having a low coefficient of friction, or may be coated with such a material.

As such, in the FIG. 4 helmet, the sliding facilitator may be provided on or integrated with the innermost side (i.e. the side closest to the wearers head) of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

The sliding facilitator may be provided on, or integrated with both the energy absorbing layer and the attachment device. For example, the sliding facilitator may be provided in two parts respectively associated with the energy absorbing layer and the attachment device. Alternatively, the sliding facilitator may comprise a layer of sliding material attached to both the energy absorbing layer and the attachment device, for example a gel material configured to shear in response to an impact.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
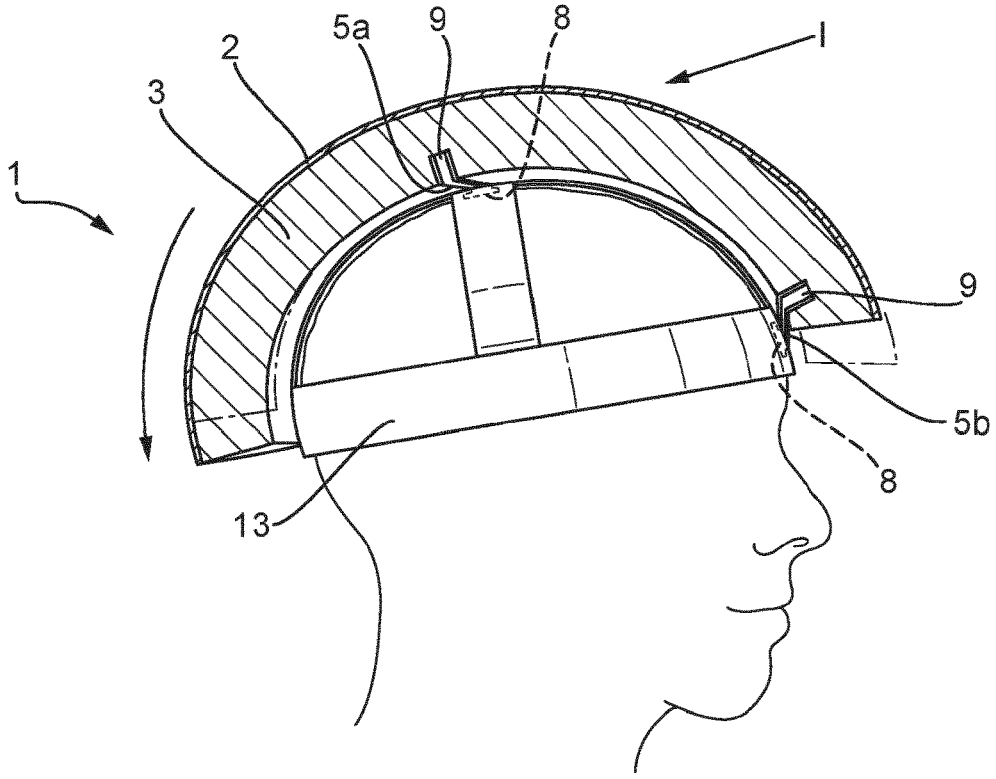
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries such as subdural haematomas, SDH, blood vessel rapturing, concussions and DAI is thereby reduced.

Figure 6:
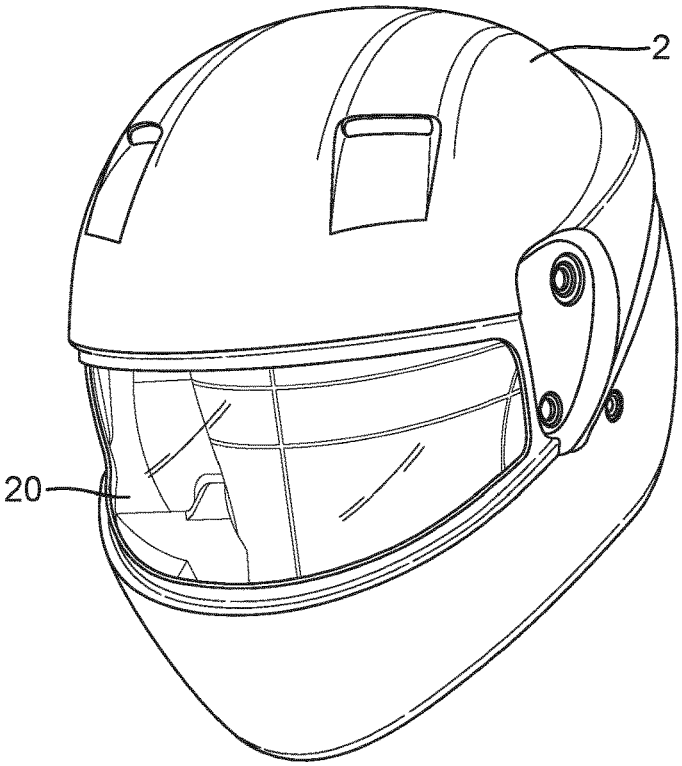
FIG. 6 shows a first example helmet in accordance with the present disclosure.

FIG. 6 is an orthogonal view of a helmet 1 in accordance with the present disclosure. The helmet 1 may be constructed, at least in part, in a similar manner to any of the example helmets described in connection with FIGS. 1 to 5. However, in the example helmet 1 of FIG. 6, the outer shell 2 covers the side of the wearer's face and/or chin. The helmet 1 of the type in FIG. 6 is sometimes referred to a as full-face helmet. The helmet 1 in FIG. 6 comprises a cheek pad 20 configured to contact a side of the wearer's face when the helmet is worn. In some examples, the cheek pad 20 may not contact the side of the wearer's head during normal use, but only under an impact to the helmet. However, in most examples, the cheek pad 20 is configured to contact the side of the wearer's face during normal use also. Optionally, a visor may be provided to cover the eye area of the wearer.

The outer shell 2 may be a relatively hard shell compared to, for example, the inner shell 3. The outer shell 2 may be substantially the same as the outer shell 2 of the helmets described in connection with the example helmets shown in FIGS. 1 to 5. Further, at least one connector connecting the outer shell 2 and the inner shell 3 and configured to allow the outer shell 2 and the inner shell 3 to slide relative to each other, may be provided. The connector may be substantially the same as the connectors described above in connection with the example helmets shown in FIGS. 1 to 5.

Figure 7:
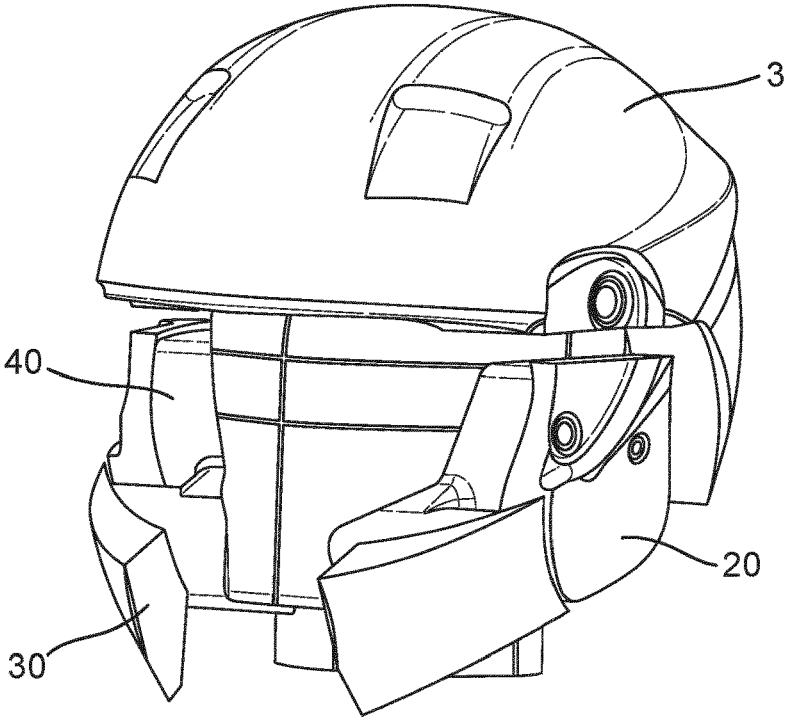
FIG. 7 shows the helmet of FIG. 6 with the outer shell removed.

FIG. 7 shows the helmet in FIG. 6 without the outer shell 2. Accordingly, the inner shell 3 and the cheek pads 20 are visible. The inner shell 3 is arranged within the outer shell 2 to protect the skull of the wearer from impact. The inner shell 3 may be provided to substantially cover the forehead, top of the head, back of the head and/or temples of the wearer. The inner shell 3 may substantially cover the cranium of the wearer. The inner shell 3 may be an energy absorbing shell configured to absorb a radial energy component of an impact. For example, the inner shell 3 may be substantially the same as the inner shell 3 described above in connection with the example helmets shown in FIGS. 1 to 5.

Cheek pads 20 may be provided on either side of the helmet 1 (i.e. left and right sides). The cheek pads 20 may be arranged within the outer shell 2 of the helmet 1 to protect the side of the face of the wearer from an impact. Accordingly, the cheek pads 20 may be arranged to substantially cover the cheek and/or chin of the wearer. The cheek pads may be configured to substantially cover the mandible of the wearer.

Figure 8:
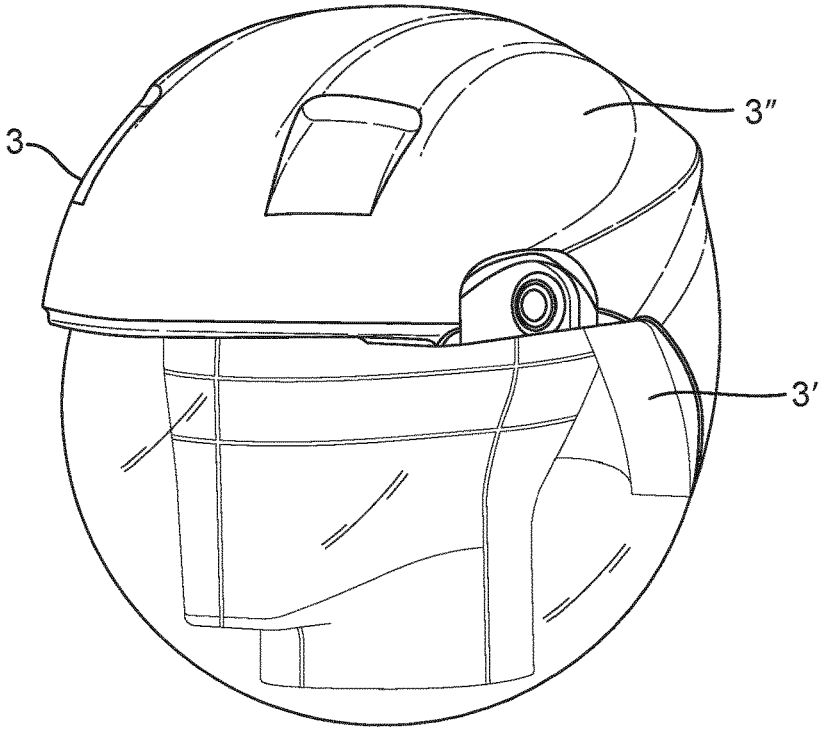
FIG. 8 shows the inner shell of the helmet shown in FIG. 6.

As stated previously, the helmet 1 may be constructed in substantially the same manner as the example helmet described in connection with FIGS. 1 to 5. Specifically, in the example helmet shown in FIG. 8, a sliding interface may be provided between an outer part of 3" of the inner shell 3 and an inner part 3' of the inner shell 3. Accordingly, the outer part 3" of the inner shell 3 and the inner part 3' of the inner shell 3 are configured to slide relative to each other at the sliding interface, in response to an impact to the helmet. This arrangement is similar to the arrangement shown in FIG. 3C. In the example of FIG. 8, the surfaces of the outer and inner parts 3", 3' at the sliding interface are spherical surfaces. The sphere corresponding to the surfaces is shown in FIG. 8 for reference.

Alternatively, a sliding interface may be providing between the outer shell 2 and the inner shell 3, such that the outer shell 2 and the inner shell 3 are configured to slide relative to each other at the sliding interface in response to an impact to the helmet. This arrangement is similar to that shown in FIGS. 1, 2, 3A and 3B. The surfaces of the outer and inner shells 2, 3 at the sliding interface may be substantially spherical surfaces.

Alternatively, the helmet may comprise an interface layer (or attachment device) between the inner shell 3 and the wearers head and configured to provide an interface for the helmet 1 with the wearers head, when the helmet is worn. A sliding interface may be provided between the inner shell 3 and the interface layer such that the inner shell 3 and the interface layer are configured to slide relative to each other at the sliding interface, in response to an impact to the helmet 1. Such an arrangement is similar to that of the example helmet shown in FIGS. 4 and 5. The interface layer may comprise comfort padding configured to provide comfort to the wearer.

In each of the above cases, sliding facilitator (or intermediate layer), may be provided at the sliding interface between the helmet shells, or parts thereof. The sliding facilitator may be substantially the same as the sliding facilitator described above on connection with the example helmets shown in FIGS. 1 to 5. Further, in each of the above cases, the sliding may occur in any direction.

Figure 9:
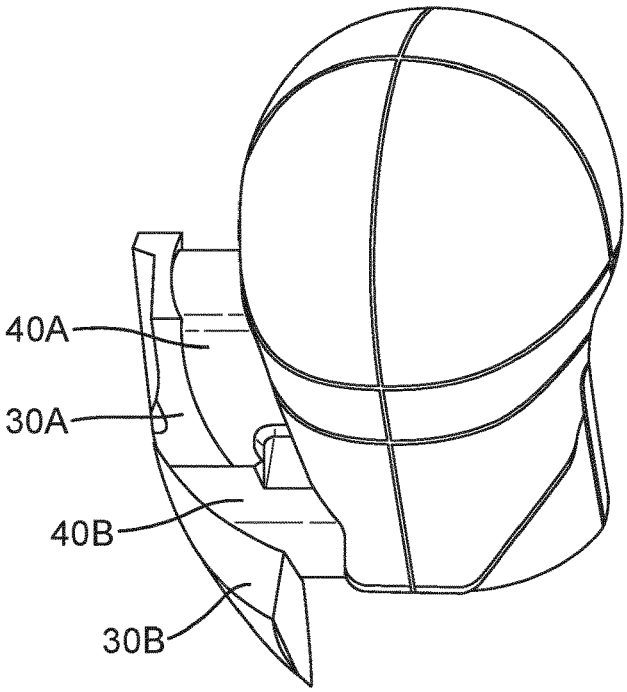
FIG. 9 shows the cheek pad of the helmet of FIG. 6.
Figure 10:
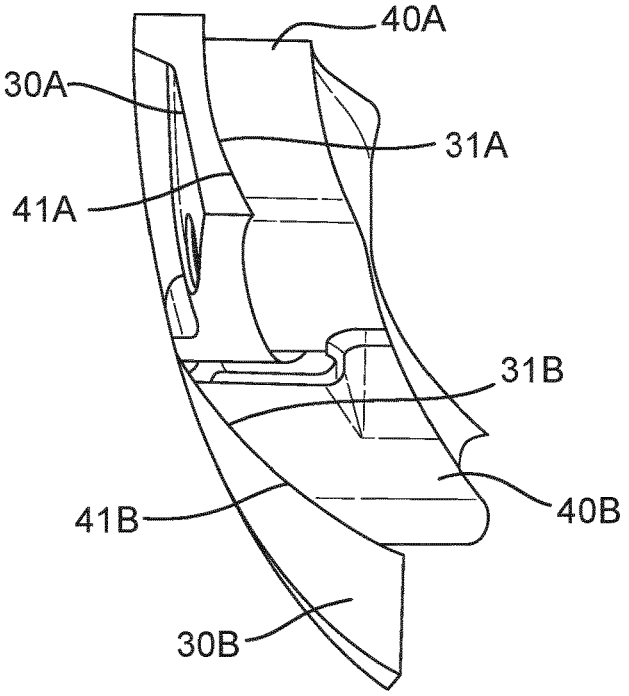
FIG. 10 shows the cheek pad of FIG. 9 in further detail.

FIGS. 9 and 10 show a first embodiment of a cheek pad 20 in accordance with the present disclosure. As shown in FIG. 9, the cheek pad 20 comprises an outer layer 30 and an inner layer 40. A sliding interface is provided between the outer layer 30 and the inner layer 40, such that the outer layer 30 and the inner layer 40 are configured to slide relative to each other at the sliding interface, in response to an impact to the helmet. The inner layer 30 is configured to contact a side of the wearer's face, when the cheek pads 20 are arranged in the helmet 1 and the helmet 1 is worn, as shown in FIG. 9.

In this embodiment, the outer layer 30 and the inner layer 40 respectively comprise multiple sections (sections 30A, 30B and 40A, 40B respectively). The outer layer 30 and the inner layer 40 each have a distinct surfaces at the sliding interface (surfaces 31A, 31B and 41A, 41B respectively) corresponding to each of the multiple sections. As shown in FIG. 10, each section 30A, 30B of the outer layer 30 opposes a corresponding section 40A, 40B of the inner layer 40 at the sliding interface. The distinct surfaces of the outer and inner layers may oppose each other. The distinct surfaces may be sliding surfaces configured to slide against an opposing surface.

Although each of the outer layer 30 and inner layer 40 shown in FIG. 10 comprises two sections, any number of multiple sections may be provided. At least two of the multiple sections of the outer layer 30 and/or the inner layer 40 may have substantially different thicknesses. In other words, the surfaces at the sliding interface of the multiple opposing sections (sections 30A, 40A and 30B, 40B respectively) may respectively be substantially different distances from the outer surface of the helmet (i.e. the outer shell) and/or from the side of the wearer's face.

As shown in FIG. 10, the cheek side section 40A of the inner layer 40 is thinner than the chin side section 40B of the inner layer 40. Conversely, the cheek-side section 30A of the outer layer 30 is thicker than to the chin-side section 30B of the outer layer 30. In the example shown, the overall thickness of the cheek pad 20 is substantially the same between the two combined sections 30A, 40A and 30B, 40B. This may be because the outer shell 2 of the helmet 1 is shaped to substantially correspond to the shape of the wearer's cheek and jaw. However, this shape may not be ideal for sliding. Therefore, the respective thicknesses of the outer layer 30 and inner layer 40 may be varied in order to improve sliding.

The cheek and jaw (mandible) are relatively aspherical (e.g. compared to the cranium) having an elongate shape coming to a point at the chin. In contrast, the ideal shape for sliding movement is a spherical shape, because no geometric locking occurs as parts move relative to each other. Accordingly, improved sliding can be obtained when the surfaces of the outer layer 30 and inner layer 40 at the sliding interface are more spherical than the natural shape of the cheek and jaw. Perfectly spherical shapes may not be necessary because only a relatively small amount of sliding movement may be required. Therefore, even non spherical surfaces may behave in a similar manner to spherical surfaces.

Preferably, the distinct surfaces at the sliding interface of the outer layer 30 and the inner layer 40 may respectively be concave and convex. The curvatures of different opposing sections (sections 30A, 40A and 30B, 40B respectively) may be different to each other. For example, those surfaces which are further from the outer surface of the helmet and/or closer to the side of the wearer's face may be more curved than those surfaces which are closer to the outer surface of the helmet and/or further from the side of the wearer's face.

Figure 11:
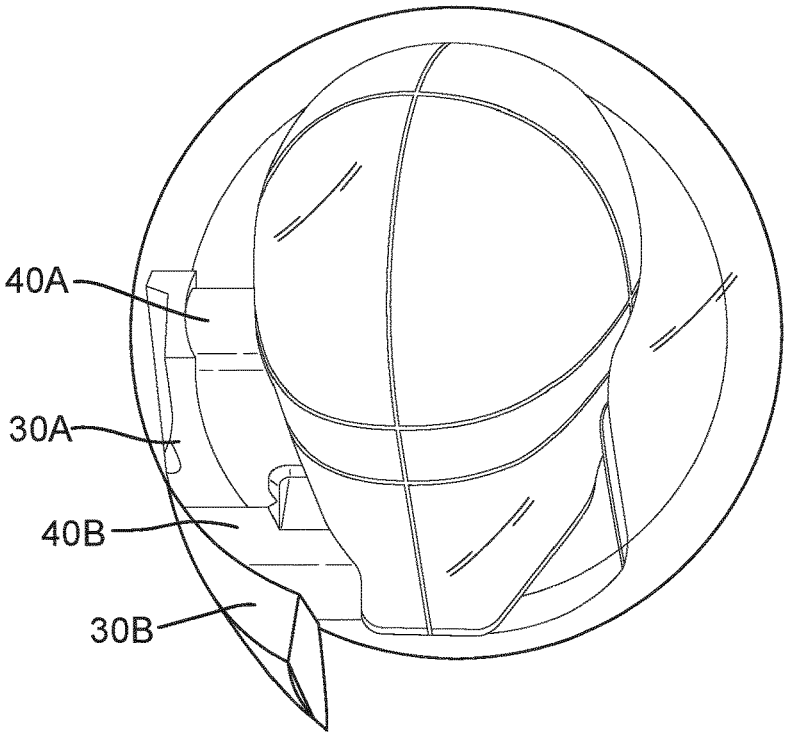
FIG. 11 shows an example cheek pad with spherical surfaces at the sliding interface.

In the example helmet 1 shown in FIGS. 9 and 10, the surfaces at the sliding interface of the outer layer 30 and the inner layer 40 are substantially spherical surfaces. The distinct surfaces at the sliding interface of the multiple sections (or at least two of the multiple sections in examples having more than two sections) of the outer layer 30 and/or the inner layer 40 have different curvatures to each other. This is illustrated by the reference spheres shown in FIG. 11. In this example helmet 1, the cheek-side sections 30A, 40A have spherical surfaces at the sliding interface corresponding to the inner sphere of FIG. 11. On the other hand, the chin-side sections 30B, 40B have spherical surfaces at the sliding interface corresponding to the outer sphere in FIG. 11. In other words, the surfaces of the cheek-side sections 30A, 40A are more curved than the chin-side sections 30B, 40B. As shown in FIG. 11, the surfaces having different curvatures are substantially concentric spherical surfaces, i.e. the spherical surfaces are surfaces of concentric spheres. Multiple spherical surfaces with different curvatures may allow spherical sliding in a non-spherical shaped helmet.

Figure 12:
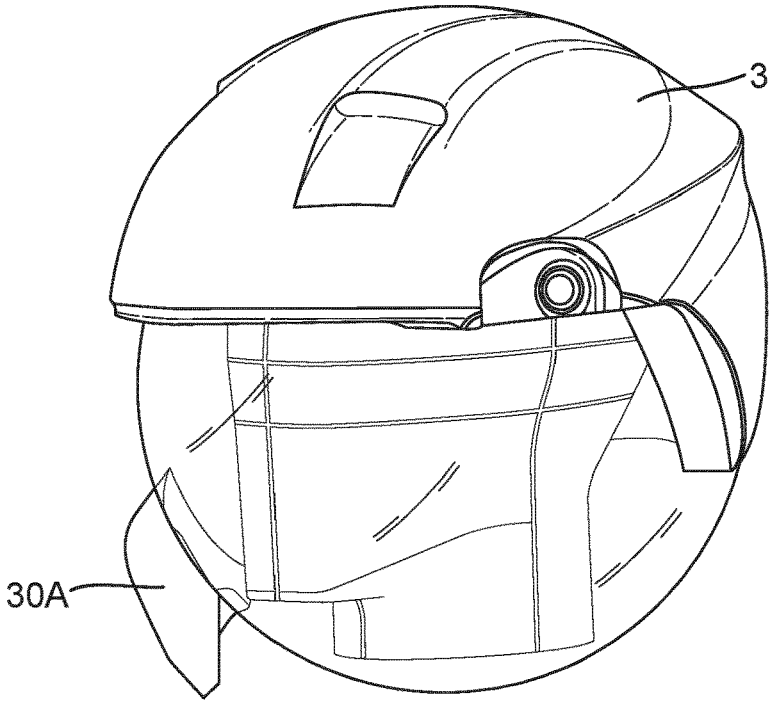
FIG. 12 shows an example of an inner helmet shell and outer layer of a cheek pad each having spherical surfaces at respective sliding interfaces.

FIG. 12 shows the chin-side section 30B of the outer layer 30 and the outer reference sphere of FIG. 11, together with the inner shell 3 of the helmet of FIG. 8. As depicted in FIG. 12, the substantially spherical surfaces at the sliding interface of the outer and inner layers 30, 40 of the cheek pad 20 may have substantially the same curvature as the substantially spherical surfaces at the sliding interface of the outer and/or inner shells 2, 3. In particular, the surface of the chin-side section 30B at the sliding interface may have the same curvature as the surface at the sliding interface of the outer part 3" of the inner shell 3. Similarly, the surface at the sliding interface of the chin side section 40B of the inner layer 40 may have the same curvature as the surface at the sliding interface of the inner part 3' of the inner shell 3. Further, surfaces of the inner and outer layers 30, 40 of the cheek pad 20 at the sliding interface may be substantially spherical surfaces that are substantially concentric with the substantially spherical surfaces of the outer and/or inner shells 2, 3.

In the first embodiment described in connection with FIGS. 6 to 12, the multiple sections of the outer layer 30 and/or the inner layer 40 (sections 30A, 30B and 40A, 40B respectively) may be formed as a single piece. Alternatively, the multiple sections of the outer layer 30 and/or the inner layer 40 may be formed as multiple respective pieces. Where the sections of the inner layer 40 are formed from multiple respective pieces, these may be configured to slide independently of each other relative to the outer layer 30.

Figure 13:
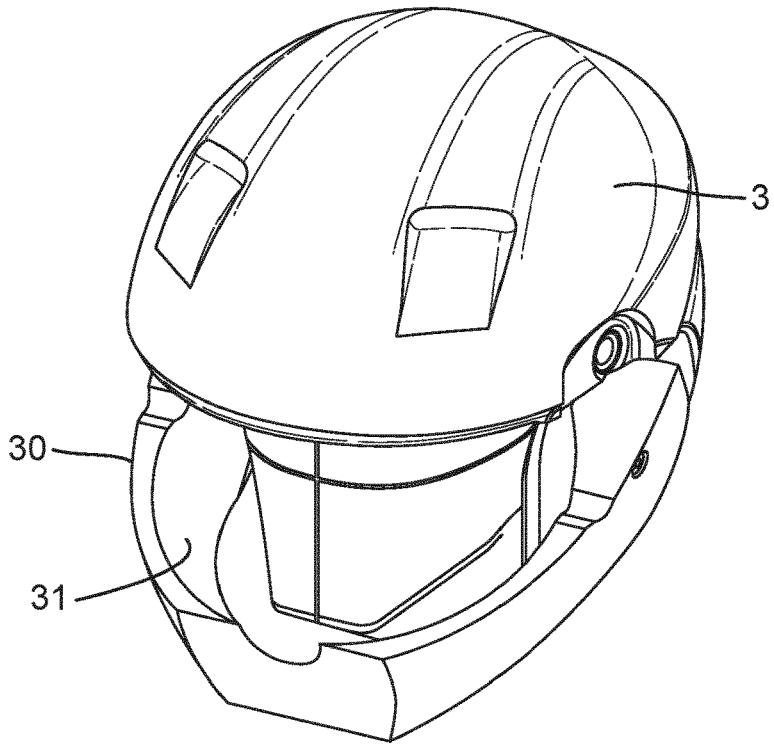
FIG. 13 shows a second example helmet in accordance with the present disclosure.

FIG. 13 shows a second embodiment of a cheek pad 20 according to the present disclosure. In this embodiment, the outer layer 30 of the cheek pad 20 is not formed from multiple sections but is instead formed from a single section. Accordingly, a single distinct surface 31 at the sliding interface is provided within the single section. The inner layer 40 of the cheek pad 20 may comprise a single section opposing the single section of the outer layer 30 at the sliding interface. Alternatively, the inner layer 40 may comprise multiple sections, each of the multiple sections having distinct surfaces corresponding to each of the multiple sections, at the sliding interface. In this case, each section of the inner layer 40 may oppose the single section of the outer layer 30 at the sliding interface.

The surfaces at the sliding interface of the outer layer 30 and the inner layer 40 at the sliding interface may be respectively concave and convex, as described above in connection with the first embodiment. In a specific example, the surfaces may be substantially spherical surfaces, as described above in connection with the first embodiment.

In both of the embodiments, and variations thereof, described above, the cheek pad 20 may further comprise an intermediate layer between the outer layer 30 and the inner layer 40 configured to facilitate the sliding between the outer layer 30 and the inner layer 40. This intermediate layer may be substantially the same as the sliding facilitator 4 described above in connection with the example helmets shown in FIGS. 1 to 5. For example, the intermediate layer may comprise a layer of low friction material provided on, attached to, or integrated with, one or both of the outer layer and the inner layer. Further, in each of the embodiments, sliding may occur in any direction.

At least one of the outer layer 30 and the inner layer 40 may be an energy absorbing layer configured to absorb a radial energy component of an impact. The energy absorbing layer may be formed from, for example, the same materials as described in relation to the energy absorbing layers of the example helmets shown in FIGS. 1 to 5. The inner layer 40 may be a comfort padding layer configured to provide comfort to the wearer.

Further, at least one connector connecting the outer layer and the inner layer and configured to allow the outer layer and the inner layer to slide relative to each other, may be provided to the cheek pad. The connector may be substantially the same as the connectors described above in connection with the example helmets shown in FIGS. 1 to 5.

Variations of the above described embodiments are possible in light of the above teachings. It is to be understood that the invention may be practiced otherwise and specifically described herein without departing from the spirit and scope of the invention.

The invention claimed is:

1. A cheek pad for a helmet, the cheek pad comprising:
an outer layer;
an inner layer; and
a sliding interface between the outer layer and the inner layer;
wherein the outer layer and the inner layer are configured to slide relative to each other at the sliding interface, in response to an impact to the helmet, and
the inner layer is configured to contact a side of the wearer's face, when the cheek pads are arranged in the helmet and the helmet is worn.

2. The cheek pad of claim 1, wherein the outer layer and the inner layer respectively comprise multiple sections; and the outer layer and the inner layer each have distinct surfaces, corresponding to each of the multiple sections, at the sliding interface.

3. The cheek pad of claim 2, wherein each section of the outer layer opposes a corresponding section of the inner layer at the sliding interface.

4. The cheek pad of claim 2, wherein at least two of the multiple sections of the outer layer and/or the inner layer have substantially different thicknesses.

5. The cheek pad of claim 2, wherein the distinct surfaces at the sliding interface of the outer layer and the inner layer are respectively concave and convex, optionally wherein the distinct surfaces at the sliding interface of the outer layer and the inner layer are substantially spherical surfaces.

6. The cheek pad of claim 2, wherein the distinct surfaces at the sliding interface of at least two of the multiple sections of the outer layer and/or the inner layer have different curvatures to each other, optionally wherein the distinct surfaces having different curvatures are substantially concentric spherical surfaces.

7. The cheek pad of claim 2, wherein the multiple sections of the outer layer and/or the inner layer are formed as a single piece.

8. The cheek pad of claim 2, wherein the multiple sections of the outer layer and/or the inner layer are formed as multiple respective pieces, optionally wherein each of the multiple respective pieces of the inner layer are configured to slide independently of each other relative to the outer layer.

9. The cheek pad of claim 1, further comprising an intermediate layer between the outer layer and the inner layer configured to facilitate the sliding between the outer layer and the inner layer, optionally wherein the intermediate layer comprises a layer of low friction material provided on, attached to, or integrated with, one or both of the outer layer and the inner layer.

10. The cheek pad of claim 1, wherein at least one of the outer layer and the inner layers is an energy absorbing layer configured to absorb a radial energy component of an impact.

11. The helmet of claim 1, wherein the inner layer is a comfort padding layer configured to provide comfort to the wearer.

12. The cheek pad of claim 1, further comprising at least one connector connecting the outer layer and the inner layer, and configured to allow the outer layer and the inner layer to slide relative to each other.

13. A helmet comprising:
an outer shell;
an inner shell, arranged within the outer shell to protect the skull of the wearer from an impact; and the cheek pad of claim 1, arranged within the outer shell to protect the side of the face of the wearer from an impact.

14. The helmet of claim 13, comprising a further sliding interface between the outer shell and the inner shell, wherein the outer shell and the inner shell are configured to slide relative to each other at the further sliding interface, in response to an impact to the helmet.

15. The helmet of claim 13, comprising a further sliding interface between an outer part of the inner shell and inner part of the inner shell, wherein the outer part of the inner shell and the inner part of the inner shell are configured to slide relative to each other at the further sliding interface, in response to an impact to the helmet.

16. The helmet of claim 14, wherein surfaces of the outer and/or inner shells at the further sliding interface are substantially spherical surfaces, optionally wherein surfaces of the inner and outer layers of the cheek pad at the sliding interface are substantially spherical surfaces substantially concentric with the substantially spherical surfaces of the shells.

17. The helmet of claim 16, wherein the substantially spherical surfaces of the outer and inner layers of the cheek pad have substantially the same curvature as the substantially spherical surfaces of the outer and inner shells respectively.

18. The helmet of claim 13, further comprising:

an interface layer between the inner shell and the wearer's head and configured to provide an interface for the helmet with the wearer's head, when the helmet is worn; and a further sliding interface between the inner shell and the interface layer;

wherein the inner shell and the interface layer are configured to slide relative to each other at the further sliding interface, in response to an impact to the helmet, optionally wherein the interface layer comprises comfort padding configured to provide comfort to the wearer.

19. The helmet of claim 13, wherein the outer shell is a relatively hard shell compared to the inner shell.

20. The helmet of claim 13, wherein the inner shell is an energy absorbing shell configured to absorb a radial energy component of an impact.

* * * * *